US006091399A

United States Patent [19]

Sumiyoshi et al.

[11] Patent Number: 6,091,399

[45] Date of Patent: Jul. 18, 2000

[54] DISPLAY CONTROLLER FOR REFRESHING OPERATOR'S VISUAL STRAIN

[75] Inventors: Hiroto Sumiyoshi; Setsuo Shimada; Tetsuya Muraoka, Dear Heights Chitosedai 207, 12-13, Chitosedai 1-chome, Setagaya-ku, all of Tokyo, Japan

[73] Assignees: NEC Corporation; Tetsuya Muraoka, both of Tokyo, Japan

[21] Appl. No.: 08/902,060

[22] Filed: Jul. 29, 1997

[30] Foreign Application Priority Data

Aug. 2, 1996 [JP] Japan ..... 8-204673

[51] Int. Cl.[7] ..... G09G 5/02; G09G 5/10

[52] U.S. Cl. ..... 345/150; 345/147

[58] Field of Search ..... 345/150, 154, 345/153, 113, 139, 419, 127, 131, 114, 302, 345, 435, 431, 427, 508, 509; 348/584, 586, 589

[56] References Cited

U.S. PATENT DOCUMENTS

| | | | |
|---|---|---|---|
| 4,907,071 | 3/1990 | Belmares-Sarabia et al. | 348/586 |
| 5,089,811 | 2/1992 | Leach | 348/584 |
| 5,270,800 | 12/1993 | Sweet | 348/584 |
| 5,293,540 | 3/1994 | Trani et al. | 348/584 |
| 5,384,593 | 1/1995 | Gell, Jr. et al. | 345/112 |
| 5,548,340 | 8/1996 | Bertram | 345/113 |
| 5,592,236 | 1/1997 | Rosenbaum et al. | 348/586 |
| 5,644,333 | 7/1997 | King et al. | 345/113 |
| 5,933,130 | 8/1999 | Wagner | 345/113 |

FOREIGN PATENT DOCUMENTS

| | | |
|---|---|---|
| 63-98695 | 4/1988 | Japan . |
| 2-166493 | 6/1990 | Japan . |
| 4-307621 | 10/1994 | Japan . |
| 7-51333 | 2/1995 | Japan . |

*Primary Examiner*—Mark R. Powell
*Assistant Examiner*—Anthony J. Blackman
*Attorney, Agent, or Firm*—Laff, Whitesel & Saret, Ltd.; J. Warren Whitesel

[57] ABSTRACT

To provide a display controller which can refresh operator's eyestrain effectively, a display controller of the invention comprises a compensation color memory (112) for storing data for displaying a compensation color image where nine colors from color phase number 13 to color phase number 21 of the Ostwald Color Ring are ranged in order, and a virtual far point memory (113) for storing data for displaying a virtual far point picture which represents a far point landscape having a calm tone and zooming out for giving an observer an impression as though the observer flies back from the far point landscape; and a control circuit (103) for displaying the compensation color image and the virtual far point picture at a predetermined interval according to operator's indication.

4 Claims, 4 Drawing Sheets

FIG. 2

| ADDRESS | COLOR PHASE | COLOR PHASE NUMBER |
|---|---|---|
| 0x00000000 | 1UB | 13 |
| 0x00022600 | 2UB | 14 |
| 0x00044c00 | 3UB | 15 |
| 0x00067200 | 1T | 16 |
| 0x00089800 | 2T | 17 |
| 0x000abe00 | 3T | 18 |
| 0x000ce400 | 1SG | 19 |
| 0x000f0a00 | 2SG | 20 |
| 0x00113000 | 3SG | 21 |

FIG. 3

| |
|---|
| 1UB : Ultramarine Blue |
| 2UB : 〃 |
| 3UB : 〃 |
| 1T : Turquioise |
| 2T : 〃 |
| 3T : 〃 |
| 1SG : Sea Green |
| 2SG : 〃 |
| 3SG : 〃 |

DISPLAY CONTROLLER FOR REFRESHING OPERATOR'S VISUAL STRAIN

BACKGROUND OF THE INVENTION

The present invention relates to a display controller for refreshing operator's visual strain, particularly caused by gazing a computer display.

There is a display controller proposed for the purpose in a Japanese patent application entitled "Character Display Device" and laid open as a Provisional Publication No. 98695/'88. In this first prior art, character data are displayed alternately at certain intervals with two complementary colors registered in a lookup table intending to reduce visual strain of the operator.

In another prior art disclosed in a Japanese patent application entitled "VDT Device", and laid open as a Provisional Publication No. 166493/'90, there are provided a color control circuit and a wrist rest for measuring operator's pulses and temperature. In this second prior art, characters are displayed with yellow color in the beginning of a VDT operation, for stimulating physical activity of the operator. According to progress of fatigue, which is measured by the pulses and temperature, the display color is controlled to change gradually from yellow to leaf green, intending to reduce operator's strain.

On the other hand, there are many offices where wall color is prepared to be different to character display color in order that operators may calm their eyes by occasionally looking the wall color.

However, even when only character display color is changed alternately into its complementary color, as disclosed in the first prior art, achromatic effect of the color stimuli is limited within a narrow area of operator's retina. So, recovery effect from fatigue caused by the color stimuli can not be obtained sufficiently.

Nor is effective to change character display color from yellow to leaf green, in such a way as proposed in the second prior art, because changing display color from yellow to leaf green has no effect to eliminate color stimuli of chromatic colors by making them achromatic with complementary colors, resulting in insufficient recovery from the fatigue caused by the color stimuli.

Effect of arranging working surroundings, such as the wall color above described, is also limited, because it is difficult to arrange the working surroundings adequately to a variety of display devices each having different character color, character size, brightness, contrast, flickering, and so on. Furthermore, it is somewhat troublesome for the operator to adjust working surroundings such as lighting or illuminations, or to look expressly a far object away from the display.

SUMMARY OF THE INVENTION

Therefore, a primary object of the present invention is to provide a display controller which can refresh operator's visual strain effectively by eliminating color stimuli imprinted on operator's retina and by relaxing ciliary muscle from fixation caused by gazing a display screen.

In order to achieve the object, a display controller for refreshing operator's visual strain of an embodiment of the invention comprises;

a caption data memory for storing caption data to be superimposed on a display screen for indicating a timing to change a picture displayed on the display screen into another picture, a video memory for storing data supplied from a CPU (Central Processor Unit) to be displayed on the display screen, a compensation color memory for storing data for displaying a compensation color image where nine colors from color phase number 13 to color phase number 21 of the Ostwald Color Ring are ranged in order, a virtual far point memory for storing data for displaying a virtual far point picture which represents a far point landscape having a calm tone and zooming out for giving an observer of the virtual far point picture an impression as though the observer flies back from the far point landscape, a picture selector for selecting picture data to be displayed on the display screen among data stored in the video memory, those in the compensation color memory and those in the virtual far point memory, a picture synthesizing circuit for synthesizing video data to be displayed on the display screen by superimposing the caption data onto picture data selected by the picture selector, when controlled; and a control circuit for controlling the picture selector according to operator's indication.

Therefore, the operator's visual strain can be effectively refreshed in the embodiment, by eliminating the color stimuli, which are accumulated on operator's retina by gazing long wave warm colors, by displaying the compensation color image of short wave cool colors which makes achromatic the color stimuli, and by relaxing ciliary muscle of operator's eye by displaying the virtual far point picture of a natural landscape having calm tones and zooming out.

BRIEF DESCRIPTION OF THE DRAWINGS

The foregoing, further objects, features, and advantages of this invention will become apparent from a consideration of the following description, the appended claims, and the accompanying drawings wherein the same numerals indicate the same or the corresponding parts.

In the drawings:

FIG. 2 is an example of an address table illustrating color data prepared in the compensation color ROM 112 of FIG. 1;

FIG. 3 illustrates a compensation color image wherein nine cool colors of FIG. 2 are ranged in order;

DETAILED DESCRIPTION OF THE PREFERRED EMBODIMENTS

Now, embodiments of the present invention will be described in connection with the drawings.

Figure 1:
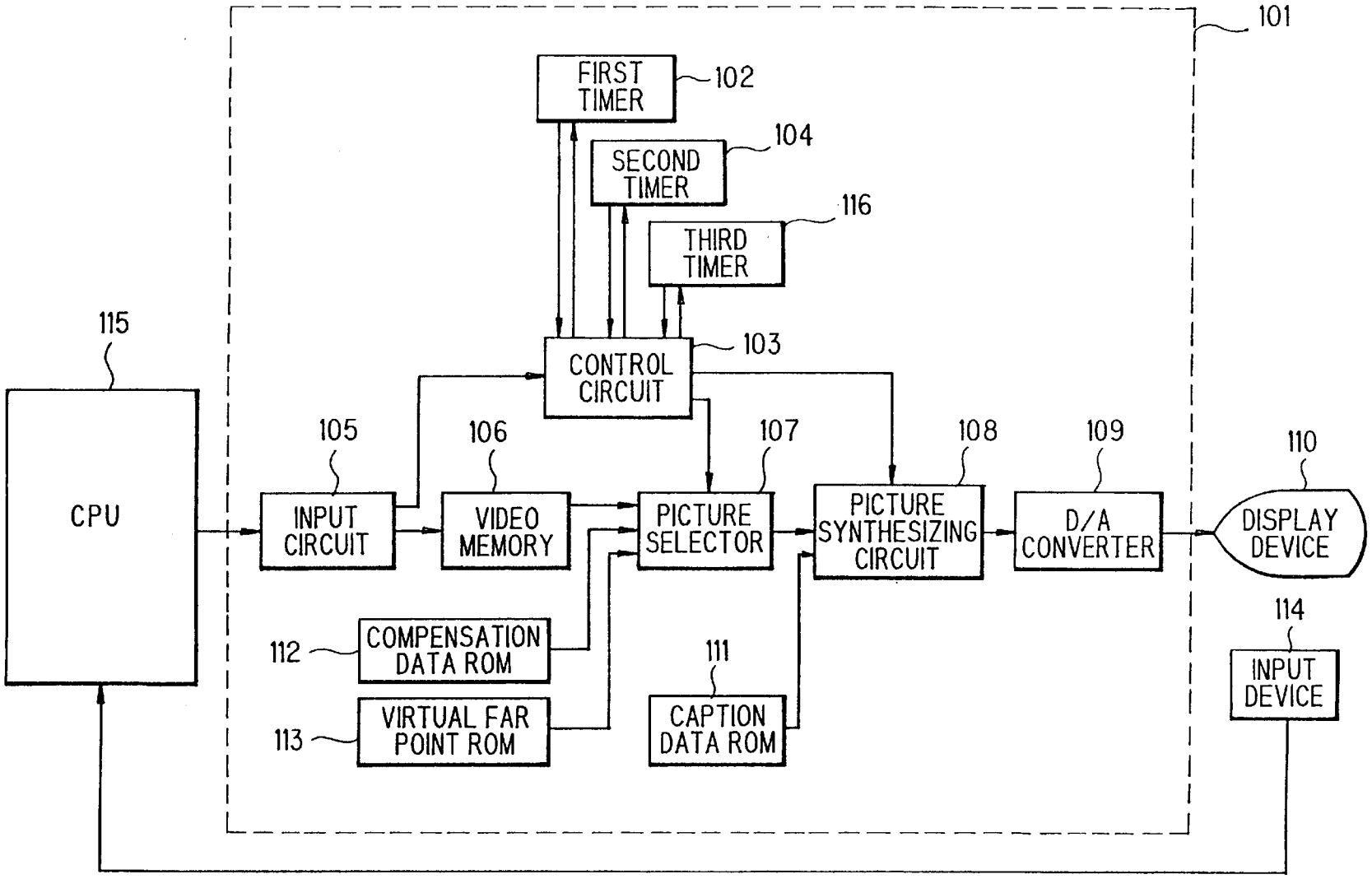
FIG. 1 is a block diagram illustrating a configuration of a display controller 101 for refreshing operator's visual strain according to an embodiment of the invention.

FIG. 1 is a block diagram illustrating a configuration of a display controller 101 for refreshing operator's visual strain according to an embodiment of the invention.

Referring to FIG. 1, the display controller 101 comprises;

an input circuit 105 for receiving display data from a CPU (Central Processor Unit) 115 having an input device 114, a video memory 106 for storing the display data received by the input circuit 105, a compensation color ROM (Read Only Memory) 112 for storing compensation color data, a virtual far point ROM 113 for storing data of virtual far point picture images, a caption data ROM 111 for storing caption data, a picture selector 107 for selecting picture data to be displayed from one of the video memory 106, the compensation color ROM 112 and the virtual far point ROM 113, a picture synthesizing circuit 108 for synthesizing video data to be displayed by superimposing the caption data prepared in the caption data ROM 111 onto picture data selected by the picture selector 107, when controlled, a D/A converter 109 for converting the video data synthesized by the picture synthesizer 108 into RGB signals to be displayed on a display device 110, a first, a second and a third timers 102, 104 and 116, and a control circuit 103 for controlling the input circuit 105, the picture selector 107 and the picture synthesizing circuit 108 referring to the first, the second and the third timers 102, 104 and 116.

Figure 4:
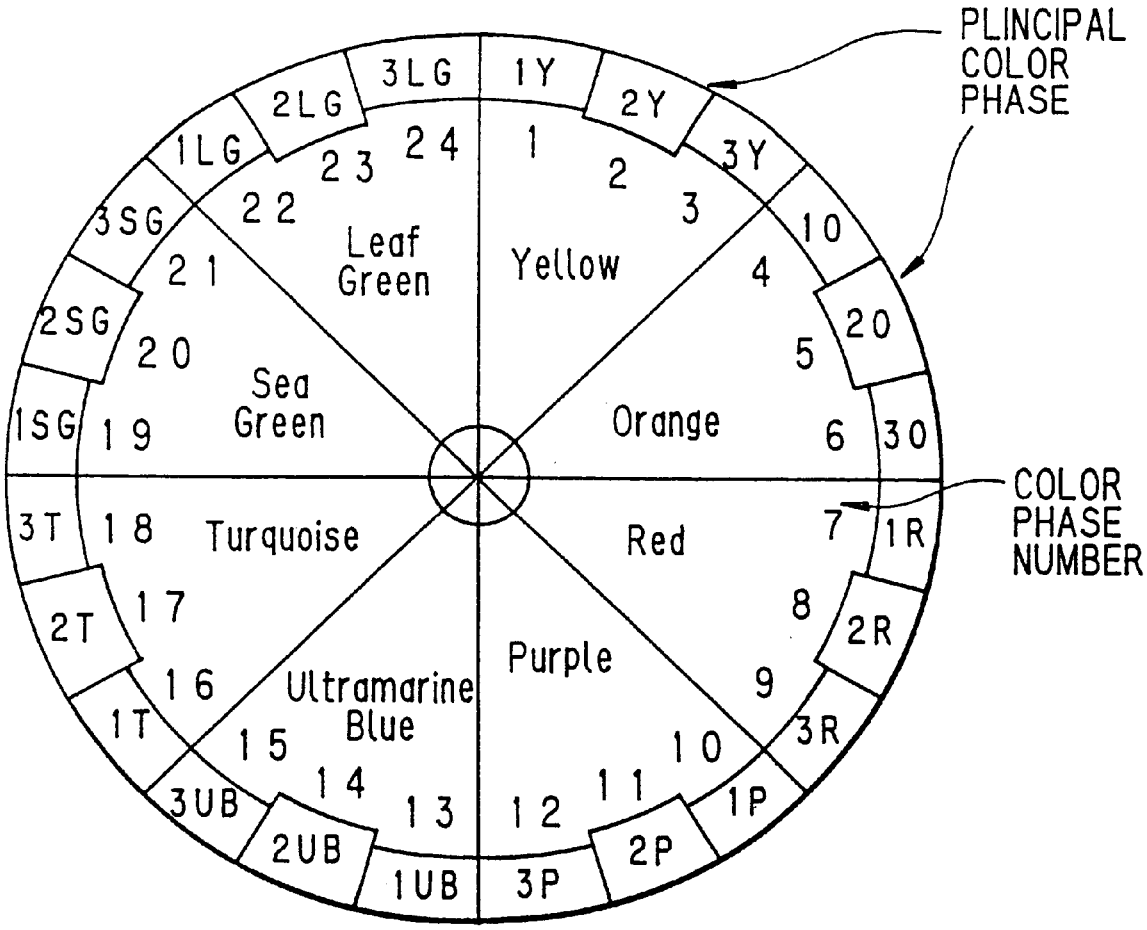
FIG. 4 illustrates the Ostwald Color Ring.

In the compensation color ROM 112, there are prepared color data of an image where nine cool colors, that is, cool colors from the first UB (Ultramarine Blue), color phase number 13 to the third SG (Sea Green), color phase number 21 of the Ostwald Color Ring shown in FIG. 4, are ranged in order vertically or horizontally. FIG. 2 is an example of an address table illustrating color data prepared in the compensation color ROM 112 for displaying a color image wherein the nine cool colors are ranged in order vertically as illustrated in FIG. 3.

Figure 5:
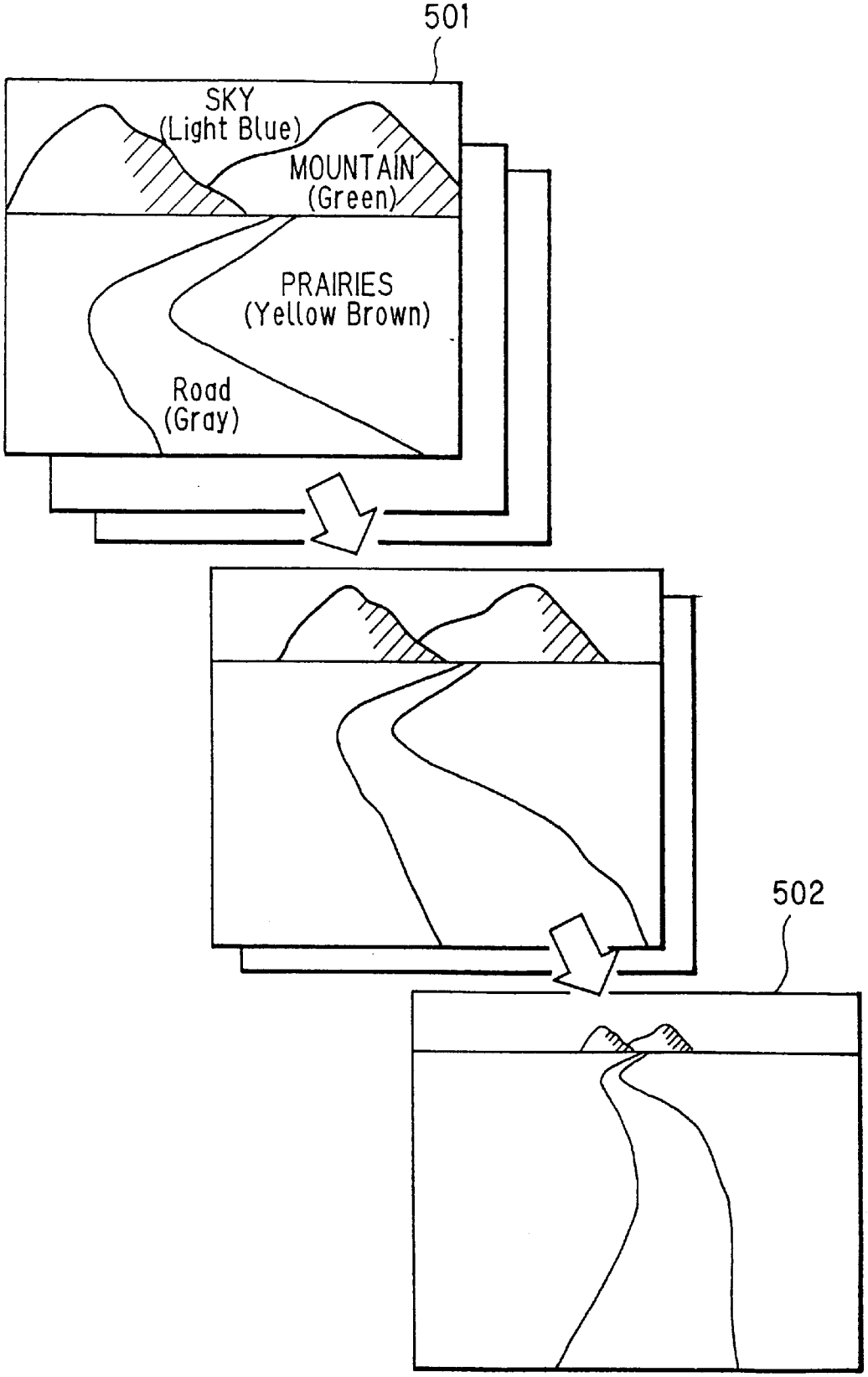
FIG. 5 illustrates an example of a virtual far point picture composed of a series of picture images from a beginning image 501 to an ending image 502.

In the virtual far point ROM 113, there are prepared data of the virtual far point picture images of a natural landscape, for example, having calm tones such as light blue, green, yellowish brown or gray for relaxing the observer. The virtual far point picture is composed of a series of picture images from a beginning image 501 to an ending image 502 as illustrated in FIG. 5, for displaying a zooming out picture in order to give the observer an impression as though the observer flies back from the landscape.

For the purpose, the far point picture is preferably so prepared that it includes far point objects, such as mountains, having highlights and shadows for giving a three-dimensional impression, that there is no other object coming in when it zooms out than the far point objects displayed in the beginning image 501 for maintaining the observer's eyes on the far point objects, and that the horizon of the far point picture rises up according to the zooming out for leading the observer's eyes a little upwards.

In the caption data ROM 111, there are prepared caption data for indicating a timing to change the display screen into the compensation color image or the virtual far point image.

The first timer 102 counts intervals at which the caption data indicating the timing to change the display screen are displayed. The second timer 104 counts a period for displaying the compensation color image, while the third timer 116 counts another period for displaying the virtual far point picture.

Now, operation of the embodiment is described.

When an operator firstly operates the input device 114, it is detected by the CPU 115 and a command is transmitted, for indicating the beginning of the operator's visual work, to the control circuit 103 through the input circuit 105. Receiving the command, the control circuit 103 starts the first timer 102 to count.

On the other hand, the display data supplied to the input circuit 105 from the CPU 115 are buffered in the video memory 106 and selected by the picture selector 107 to be displayed on the display device 110 through the picture synthesizing circuit 108 and the D/A converter 109.

When the count value of the first timer 102 arrives at a first predetermined interval, the first timer 102 outputs a first timing signal, with which the control circuit 103 controls the picture synthesizing circuit 108 to superimpose the caption data stored in the caption data ROM 111 on the display data supplied from the CPU 115.

Recognizing the caption data superimposed on the display screen, the operator inputs a reply to display the compensation color image, to display the virtual far point picture or to continue the visual work.

In case the operator selects to continue the visual work, the control circuit 103 controls the picture synthesizing circuit 108 to stop superimposing the caption data, resetting the first timer 102 to count the next interval.

In case the operator permits the CPU 115 through the input device 114 to display the compensation color image, the CPU 115 suspends the visual work and sends a command to the control circuit 103 through the input circuit 105 for displaying the compensation color image. Receiving the command, the control circuit 103 controls the picture selector 107 to select data of the compensation color image prepared in the compensation color ROM 112 to be displayed and starts the second timer 104 to count the time interval where the compensation color image is displayed. The data selected by the picture selector 107 are supplied to the display device 110 through the picture synthesizing circuit 108 and the D/A converter 109 for displaying the compensation color image such as illustrated in FIG. 4, wherein the nine cool colors from the first UB to the third SG, having inhibition effect for human bodies, are ranged vertically, for making calm the operator both physically and psychologically.

By looking the compensation color image, the color stimuli accumulated on operator's retina and central nerves, which are mainly caused in the visual work by gazing long wave warm colors having promoting and exciting effect for the human body and mind, are eliminated, by compensating and making achromatic the color stimuli with the cool colors complementary to the long wave warm colors.

When the second timer 104 counts a second predetermined interval, the second timer 104 outputs a second timing signal to the control circuit 103. Receiving the second timing signal, the control circuit 103 controls the picture selector 107 to select the data prepared in the virtual far point ROM 113 for displaying the virtual far point picture, starting the third timer 116, in the embodiment.

The virtual far point picture are composed of a series of picture images such as shown in FIG. 5, as beforehand described, for displaying a bird's-eye view of a landscape zooming out for giving the observer the impression as though the observer flies back from the landscape, relaxing focusing mechanism of the operator's eye effectively.

Counting a third predetermined interval, the third timer 116 outputs a third timing signal to the control circuit 103, with which the control circuit 103 controls the picture selector 107 to select data stored in the video memory 106 to be displayed for the operator resuming the suspended visual work.

Thus, the operator's visual strain can be effectively refreshed in the embodiment, by eliminating the color stimuli, which are accumulated on operator's retina by gazing long wave warm colors, by displaying the compensation color image of short wave cool colors which makes achromatic the color stimuli, and by relaxing ciliary muscle of operator's eye by displaying the virtual far point picture of a natural landscape having calm tones and zooming out.

The operator may select to display the virtual far point picture directly responding to the caption data. Further, the operator may resume the visual work directly after looking the compensation color image, even though the compensation color image is described in the embodiment to be followed by the virtual far point picture.

What is claimed is:

1. A display controller for refreshing an operator's vision in order to reduce eyestrain, said controller comprising:

a caption data memory for storing caption data to be superimposed on a display screen for indicating a timing to change a picture displayed on said display screen into another picture;

a video memory for storing data supplied from a CPU (Central Processor Unit) to be displayed on said display screen;

at least one picture memory for storing picture data for refreshing the operator's vision to reduce eyestrain, wherein said at least one picture memory includes a compensation color memory for storing data for displaying a compensation color image in nine colors in a range from color phase number 13 to color phase number 21 of the Ostwald Color Ring are ranged in order;

a picture selector for selecting picture data to be displayed on said display screen from among data stored in said video memory and data stored in said at least one picture memory;

a picture synthesizing circuit for synthesizing video data to be displayed on said display screen by superimposing said caption data onto picture data selected by said picture selector;, and a control circuit for controlling said picture selector according to an operator's indication.

2. The display controller recited in claim 1, wherein said at least one picture memory including a compensation color memory for storing data for displaying a compensation color image where nine colors from color phase number 13 to color phase number 21 of the Ostwald Color Ring are ranged in order.

3. The display controller recited in claim 1, wherein said at least one picture memory including a virtual far point memory for storing data for displaying a virtual far point picture which represents a far point landscape having a calm tone and zooming out for giving an observer of said virtual far point picture an impression as though the observer flies back from the far point landscape.

4. The display controller recited in claim 1, wherein there are a plurality of said picture memories and further comprising:

first timer means for counting a first time interval, at which time said caption data are to be superimposed on said display screen; and other timer means each of said other timer means corresponding to an associated one of, each of said picture memories and counting each interval during which data stored in each respective one of said picture memories are to be selected by said picture selector.

* * * * *